United States Patent [19]

Fidler et al.

[11] Patent Number: 4,714,072

[45] Date of Patent: Dec. 22, 1987

[54] MECHANICALLY ATTACHED TWO COMPONENT CERAMIC FIBER SYSTEM

[75] Inventors: Fredrick H. Fidler, Evans, Ga.; Thomas B. Lowe, North Augusta, S.C.

[73] Assignee: The Babcock & Wilcox Company, New Orleans, La.

[21] Appl. No.: 887,677

[22] Filed: Jul. 18, 1986

[51] Int. Cl.[4] ..... F24C 1/00

[52] U.S. Cl. ..... 126/1 F; 52/384

[58] Field of Search ..... 126/114, 1 F; 52/384; 138/140

[56] References Cited

U.S. PATENT DOCUMENTS

| | | | |
|---|---|---|---|
| 1,590,721 | 6/1926 | Bodurtha | 126/1 F |
| 2,206,680 | 7/1940 | Sitton | 126/1 F |
| 2,892,563 | 6/1959 | Morrison | 126/1 F |
| 4,201,247 | 5/1980 | Shannon | 138/140 X |

FOREIGN PATENT DOCUMENTS

| | | | |
|---|---|---|---|
| 131463 | 8/1919 | United Kingdom | 126/275 X |

*Primary Examiner*—Larry Jones

*Attorney, Agent, or Firm*—Vytas R. Matas; Robert J. Edwards

[57] ABSTRACT

A system for mechanically attaching two layers of ceramic fiber material is disclosed. Each layer of ceramic fiber material contains one or more ceramic tubes which are parallel to the interface formed between the layers. Each ceramic tube in one layer is aligned with a ceramic tube in the other layer and ceramic links interconnect the aligned pairs of ceramic tubes forming a mechanical attachment between the layers of material.

16 Claims, 2 Drawing Figures

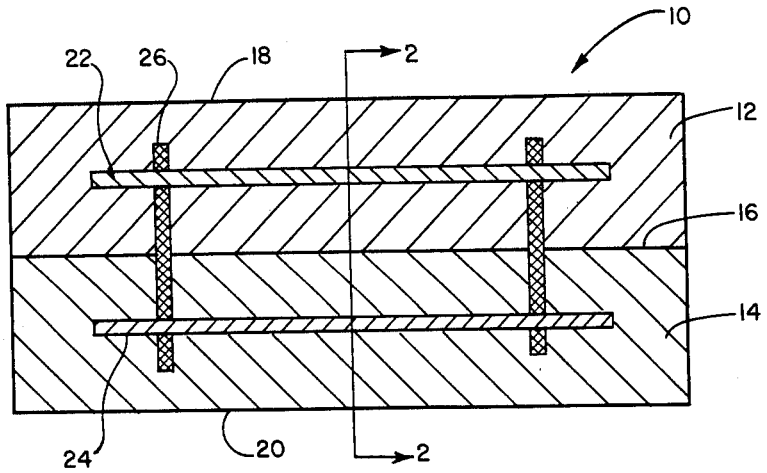
FIG. 1
FIG. 2
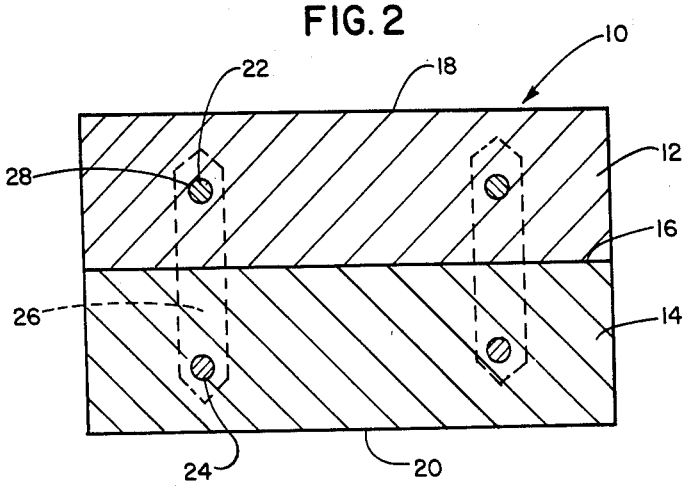

MECHANICALLY ATTACHED TWO COMPONENT CERAMIC FIBER SYSTEM

TECHNICAL FIELD

The present invention relates generally to a system for attaching one layer of ceramic fiber material to another layer of ceramic fiber material, and more particularly to a system for mechanically attaching the ceramic fiber layers using components fabricated from ceramic materials.

BACKGROUND ART

Ovens or furnaces which are operable in excess of 2500° F. are typically lined with dense refractory materials, such as firebrick. Such materials, because of their high density, usually have relatively high heat storage capacity resulting in significantly long periods of time being required to increase or decrease the temperature within the oven or furnace. Thus, such dense refractory materials hinder the cyclical operation of an oven or furnace by greatly increasing cycle time. In view of the foregoing, the lower density and resulting reduced heat storage capacity of ceramic fiber material makes such material desirable as a lining for those ovens and furnaces which operate in a cyclical manner and which approach and/or exceed an operating temperature of 2500° F.

Ceramic fiber materials have been utilized as linings for ovens or furnaces for some time. It has been found that standard alumina-silica ceramic fiber blankets, when used as a lining material, exhibit excessive shrinkage at extremely high temperatures. Similarly, it has been found that high alumina-ceramic fibers cannot be formed into blankets with sufficient strength to be used as a lining material. The most common approach for overcoming these limitations is to vacuum form a "blend" of standard alumina-silica ceramic fibers and high alumina ceramic fibers into boards or modules which can be cemented to the surface of conventional refractory material. This approach puts the low density, thermally efficient ceramic fiber material on the "hot" side of the lining where it can have a significant effect, but does not provide the full advantage of a completely ceramic fiber lining since refractory material is still utilized as the "back-up" material.

Another approach that has been utilized is to use boards of "blended" ceramic fibers as the final layer in a multi-layer type lining. With this approach several layers of alumina-silica ceramic fiber blankets are impaled over high alumina "spike" anchors. The final layer in such an installation is a "blended" ceramic fiber board held in place by high alumina washers which fit into notches in the spikes. Although this approach has produced satisfactory results in ovens or furnaces operating at less than 2500° F., it has been found that growth, warpage and breakage of the boards occur in installations operating in excess of 2500° F.

A still another approach that has been investigated is to cement modules formed from high temperature ceramic fibers to "back-up" linings formed from lower temperature ceramic fibers. It has been found with this approach that the resulting composite material will adhere to the vertical walls of the oven or furnace but not to the top surface thereof. Further investigation has revealed that the strengths of the refractory cements or mortars that are utilized to hold the two ceramic fiber layers together have definite limitations, and typically there is some devitrification of the lower temperature ceramic fiber near the cemented interface between the ceramic fiber layers. Such devitrification reduces the fiber strength in the general area of the interface. Typically, the cement provides sufficient bonding and holding strength to hold the composite material to the vertical walls of the oven or furnace, but gravity overcomes the bonding and holding strength of the cement on overhead surfaces thus causing the modules to pull away from the lower temperature ceramic fibers utilized as the "back-up" lining.

Because of the foregoing, it has become desirable to develop a means for attaching together two layers of ceramic fiber material so that the resulting assembly can be utilized in any orientation in an oven or furnace which operates at very high temperatures.

SUMMARY OF THE INVENTION

The present invention solves the aforementioned problems associated with the prior art as well as other problems by providing apparatus for mechanically attaching one layer of ceramic fiber material to another layer of such material. The apparatus includes one or more ceramic tubes located in each of the two layers of the ceramic fiber material to be attached and ceramic links for interconnecting the tubes in one layer to the tubes in the other layer. The tubes are positioned within the layers so as to be parallel to the interface between the layers and each tube in one layer is aligned with and parallel to a correspbnding tube in the other layer. Each of the tubes in one layer of ceramic fiber material is received through an aperture in the end of a ceramic link located in that layer while the corresponding aligned parallel tube in the other layer of ceramic fiber material is received through the aperture in the opposite end of the same ceramic link located in that layer. In this manner, the layers of ceramic fiber material are mechanically attached together permitting the assembly to be used in any orientation in an oven or furnace.

BRIEF DESCRIPTION OF THE DRAWINGS

FIG. 1 is a cross-sectional view of the present invention.

FIG. 2 is a cross-sectional view taken along section lines 2—2 of FIG. 1.

DESCRIPTION OF THE PREFERRED EMBODIMENT

Referring now to the drawings where the illustrations are for the purpose of describing the preferred embodiment of the present invention and are not intended to limit the invention disclosed herein, FIG. 1 is a cross-sectional view of the present invention. As such, this Figure illustrates an assembly 10 of two layers of ceramic fiber material which are mechanically attached together by components formed or fabricated from ceramic material.

As illustrated in FIG. 1, the assembly 10 includes a first layer 12 of ceramic fiber material which is positioned on top of a second layer 14 of ceramic fiber material forming an interface 16 therebetween. The layers 12, 14 of ceramic fiber matefial might be in the form of modules of resilient ceramic fibers or the modules might be somewhat rigid. In either case, since the layers are formed from ceramic fiber material, they typically have good thermal insulating properties. Depending upon the type of ceramic fibers utilized, the layers can have different limits as to the maximum temperatures which they can withstand. In the preferred embodiment of the present invention, the first layer 12 of ceramic fiber material can be formed from a lower temperature ceramic material than the second layer 14 since the surface 18 of the first layer 12 is placed adjacent the oven or furnace wall when the assembly 10 is installed within same, whereas the surface 20 of the second layer 14 is adjacent the electrical heating element within the oven or furnace. Ideally the first layer 12 of ceramic fiber material can be a PYRO-BLOC brand insulation module and the second layer 14 of ceramic fiber material can be a UNIFELT brand insulation module both available from the Babcock & Wilcox Co. of McDermott, Inc., however, any other types of ceramic fiber insulating material can be used.

Each of the layers 12, 14 of ceramic fiber material is provided with one or more ceramic tubes 22, 24 respectively located therein. The ceramic tubes 22, 24 are positioned so as to be parallel to the interface 16, and each tubes 22 within the layer 12 is aligned with and parallel to a corresponding tube 24 in layer 14. One or more bar-shaped links 26, formed from ceramic material, are provided and are positioned so that one end thereof is located within layer 12 and the other end thereof is located within layer 14. An aperture 28, having a diameter greater than the diameter of the ceramic tubes 22, 24, is provided in the oppositely disposed ends of each of the ceramic links. The longitudinal distance between the oppositely disposed apertures 28 in each link 26 approximates the transverse distance between a tube 22 in layer 12 and the corresponding aligned parallel tube 24 in layer 14 to which it is to be attached. Each of the tubes 22 in layer 12 is received through the aperture 28 in the end of one or more links 26 located in layer 12 while the corresponding aligned parallel tube 24 in layer 14 is received through the aperture 28 in the opposite end of the same one or more links 26 located in layer 14. In this manner, the layers 12, 14 of ceramic fiber material are mechanically attached together through the interconnection of the tubes 22, 24 with the links 26.

As previously stated, the foregoing assembly 10 is installed in an oven or furnace in such a manner that surface 18 of the first layer 12 of ceramic fiber material (the lower temperature ceramic material) is placed adjacent the oven or furnace wall while surface 20 of the second layer 14 of ceramic fiber material (the higher temperature ceramic material) is positioned adjacent the electrical heating element within the oven or furnace. The foregoing installation can be accomplished by anchoring techniques that are well known in the art and thus will not be discussed herein. Since the layers 12, 14 are mechanically attached rather than cemented to each other as in the prior art, the assembly 10, in sheet or modular form, can be anchored to not only the sides of the oven or furnace but also to the top surface thereof because gravity has no effect on the resulting installation. In addition, if the assembly 10 is utilized in modular form, defective modules can be easily removed and replaced thus minimizing maintenance problems and downtime. And lastly, since ceramic fiber material is utilized as the insulating medium, the advantages of such material, viz., resistance to extremely high temperatures and rapid cycling capability, can be realized in any installation utilizing the present invention.

Certain .modifications and improvements will occur to those skilled in the art upon reading the foregoing, it should be understood that all such modifications and improvements have been deleted herein for the sake of conciseness and readability but are properly within the scope of the following claims.

We claim:

1. Apparatus for attaching one layer of fibrous material comprising a first tubular member received in a first layer of fibrous material, a second tubular member received in a second layer of fibrous material, and means for connecting said first tubular member and said second tubular member including a link member having a pair of apertures therein to receive said first tubular member and said second tubular member.

2. The apparatus as defined in claim 1 wherein one of said apertures is located adjacent one end of said link member and another of said apertures is located adjacent another end of said link member.

3. The apparatus as defined in claim 2 wherein the longitudinal distance between said one of said apertures and said another of said apertures in said link member is approximately the same as the longitudinal distance between said first tubular member and said second tubular member.

4. The apparatus as defined in claim 1 wherein said first tubular member and said second tubular member are positioned so as to be substantially parallel to the interface formed between the first layer of fibrous material and the second layer of fibrous material.

5. The apparatus as defined in claim 1 wherein said first tubular member and said second tubular member are substantially parallel to each other and the axis of said first tubular member and said second tubular member are substantially aligned with one another.

6. The apparatus as defined in claim 1 wherein at least one of said first and second tubular members is formed from ceramic material.

7. The apparatus as defined in claim 1 wherein said connecting means is formed from ceramic material.

8. Apparatus for attaching one layer of fibrous material to another layer of fibrous material comprising a first layer of fibrous material, a second layer of fibrous material positioned on said first layer of fibrous material, a first tubular member received in said first layer of fibrous material, a second tubular member received in said second layer of fibrous material, and means for connecting said first tubular member and said second tubular member including a link member having pair of aperture therein to receive said first tubular member and said second tubular member.

9. The apparatus as defined in claim 8 wherein one of said apertures is located adjacent one end of said link member and another of said apertures is located adjacent another end of said link member.

10. The apparatus as defined in claim 9 wherein the longitudinal distance between said one of said apertures and said another of said apertures in said link member is approximately the same as the longitudinal distance between said first tubular member and said second tubular member.

11. The apparatus as defined in claim 8 wherein said first tubular member and said second tubular member are positioned so as to be substantially parallel to the interface formed between said first layer of fibrous material and said second layer of fibrous material.

12. The apparatus as defined in claim 8 wherein said first tubular member and said second tubular member are substantially parallel to each other and the axis of said first tubular member and said second tubular member are substantially aligned with one another.

13. The apparatus as defined in claim 8 wherein at least one of said first and second layers of fibrous material is formed from ceramic fibers.

14. The apparatus as defined in claim 8 wherein at least one of said first and second tubular members is formed from ceramic material.

15. The apparatus as defined in claim 8 wherein said connecting means is formed from ceramic material.

16. Apparatus for attaching one layer of fibrous material to another layer of fibrous material comprising a first tubular member received in a first layer of fibrous material, a second tubular member received in a second layer of fibrous material, and aperatured linking means for connecting said first tubular member and said second tubular member.

* * * * *